US005159859A

United States Patent [19]

Whitesell

[11] Patent Number: 5,159,859

[45] Date of Patent: Nov. 3, 1992

[54] SHINGLE LIFTING TOOL

[76] Inventor: David E. Whitesell, 6 Talbot St., E., Wheatley, Ontario, N0P 2P0, Canada

[21] Appl. No.: 685,207

[22] Filed: Apr. 15, 1991

[51] Int. Cl.[5] ..... B25B 33/00

[52] U.S. Cl. ..... 81/45; 30/169

[58] Field of Search ..... 81/45, 46; 30/169, 170; 299/37; 15/93.1; 254/131, 131.5

[56] References Cited

U.S. PATENT DOCUMENTS

| | | | |
|---|---|---|---|
| 1,107,919 | 8/1914 | Douglass | 30/170 |
| 2,769,236 | 11/1956 | Phillips et al. | 30/169 |
| 4,324,042 | 4/1982 | Lipka et al. | 30/170 |
| 4,466,188 | 8/1984 | Svendsgaard | 254/131.5 X |
| 4,549,350 | 10/1985 | Patillo | 30/170 |
| 5,001,946 | 3/1991 | Shirlin et al. | 81/45 |

*Primary Examiner*—James G. Smith
*Attorney, Agent, or Firm*—Burke-Robertson

[57] ABSTRACT

A tool is provided for lifting and rolling for removal ordinary roofing shingles which have been nailed on roofs. The tool comprises an articulated, elongated handle having upper and lower sections joined at an intermediate pivot, the lower section angled forwardly, out of alignment with respect to the upper section. The pivot permits relative pivotal movement of the lower section with respect to the upper section to vary the angle it makes therewith. Means are provided to secure the lower section at an angle within a range of angles with respect to the upper section. A flat blade is secured to the free end of the lower section for slipping beneath shingles, for lifting and rolling thereof. The blade comprises a plurality of spaced tines extending in a direction parallel to the longitudinal axis of the lower section. The tool according to the present invention provides a construction of shingle lifting tool which will facilitate the lifting and rolling of ordinary roofing shingles.

12 Claims, 1 Drawing Sheet

SHINGLE LIFTING TOOL

BACKGROUND OF THE INVENTION

The present invention relates to a tool for lifting and rolling, for removal, ordinary roofing shingles which have been nailed on roofs.

Tools for removing shingles from roofs have been known. Typical of such devices are those described and illustrated in Canadian Patents Nos. 83,883 of Mitchell dated Nov. 10, 1903, 449,745 of Gustowski issued Jul. 13, 1948 and 949,313 of Crispino dated Jun. 18, 1974. Such devices conventionally have a handle and a blade, the blade being provided with forwardly extending teeth.

Also of background interest is U.S. Pat. No. 3,436,111 of England issued Apr. 1, 1969 which describes and illustrates a hand tool in which the handle is parallel to, but offset from, the blade to facilitate the use of the tool for lifting a load of material, shovelling or digging.

It is an object of the present invention to provide an alternative construction of shingle lifting tool which will facilitate the lifting and rolling of ordinary roofing shingles.

SUMMARY OF THE INVENTION

In accordance with the present invention, a tool is provided for lifting and rolling for removal ordinary roofing shingles which have been nailed on roofs. The tool comprises an articulated, elongated handle having upper and lower sections joined at an intermediate pivot, the lower section angled forwardly, out of alignment with respect to the upper section. The pivot permits relative pivotal movement of the lower section with respect to the upper section to vary the angle it makes therewith. Means are provided to secure the lower section at an angle within a range of angles with respect to the upper section. A flat blade is secured to the free end of the lower section for slipping beneath shingles, for lifting and rolling thereof. The blade comprises a plurality of spaced tines extending in a direction parallel to the longitudinal axis of the lower section.

In a preferred embodiment of the present invention the lower section is provided with a rearwardly extending curved arch. A portion of the arch is to rest on the roof and provide a fulcrum point for lifting shingles with the blade when the upper section is lowered with respect to the roof.

The tool according to the present invention is adjustable to suite both worker height and roof slope. In the preferred embodiment having the arch, the arch is close to the tines to allow prompt contact at the leverage point while the upper section of the handle promotes ease of work.

BRIEF DESCRIPTION OF THE DRAWINGS

These and other objects and advantages of the invention will become apparent upon reading the following detailed description and upon referring to the drawings in which.

Figure 1:
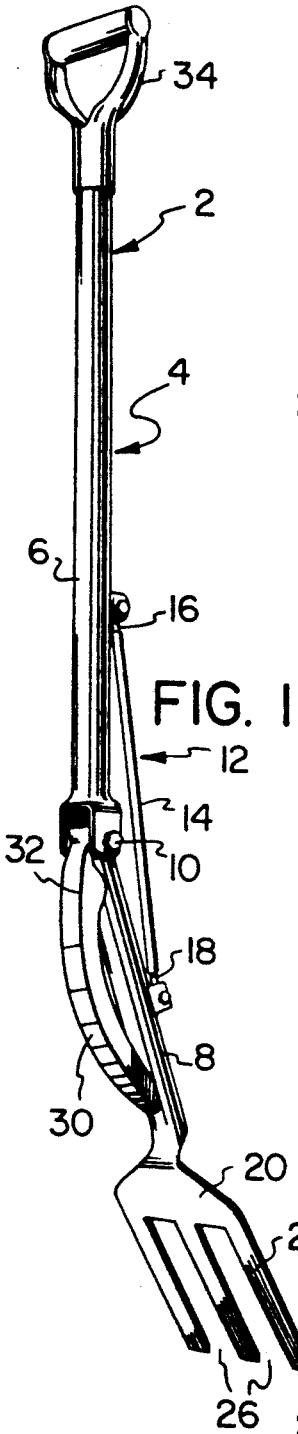
FIG. 1 is a perspective view, from the rear, of a shingle lifting tool according to the present invention.

While the invention will be described in conjunction with an example embodiment, it will be understood that it is not intended to limit the invention to such an embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
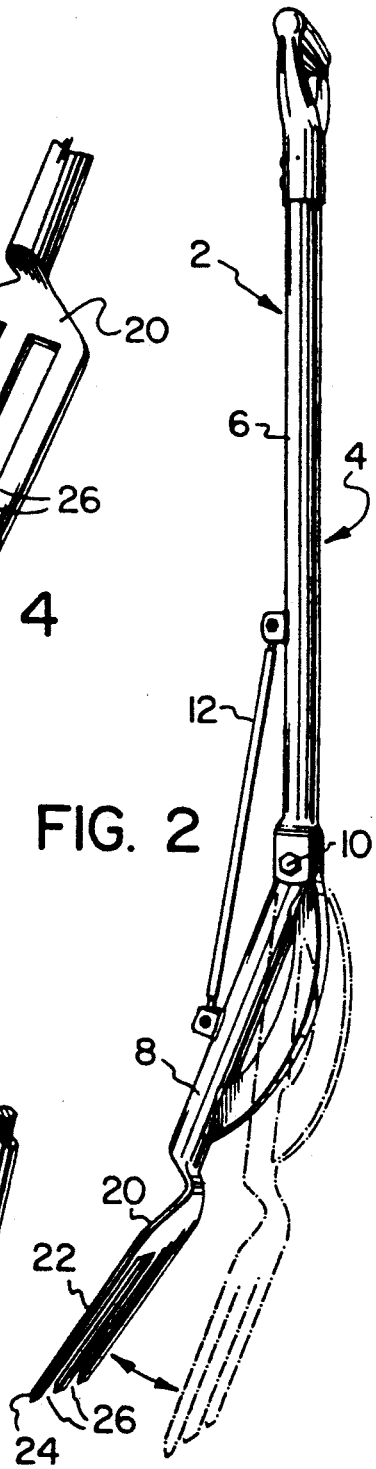
FIG. 2 is a side view of the tool of FIG. 1.
Figure 3:
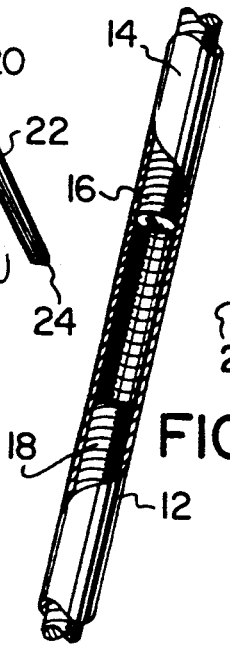
FIG. 3 is a partial view, in partial section, of a turnbuckle adjustment mechanism for the tool of FIGS. 1 and 2.

Turning to FIGS. 1 and 2, a shingle lifting and rolling tool 2 according to the present invention is illustrated having an articulated handle 4, with a longer upper section 6 and lower section 8 joined at pivot 10. Lower section 8 is angled forwardly, out of alignment with respect to upper section 6. Pivot 10 permits relative pivotal movement of the lower section with respect to the upper section 6 of handle 4 as illustrated, over a range of angles. Pivot 10 is located at a point approximately two-thirds of the way down handle 4. A turnbuckle 12 extends between upper section 6 and lower section 8 as illustrated, to secure lower section 8 at a desired angle with respect to upper section 6. Turnbuckle 12, as illustrated in FIG. 3, essentially comprises a sleeve 14 which is internally threaded, at one end with a left hand screw thread and at the other with a right hand screw thread, and appropriate screw swivels 16 and 18 are secured as illustrated to upper section 6 and lower section 8 respectively, these swivels having opposite threads to threadably engage opposite ends of sleeve 14 as illustrated. This arrangement ensures that lower section 8 is adjustable to a variety of angles, with respect to upper section 6, and is maintained at a desired angle within that range, for proper operation of the device. That angle may be adjusted, for example to reflect a different size of worker or a different roof angle. It is preferred that lower section 8 make an angle of between 5° and 15° with respect to the longitudinal axis of upper section 6.

Figure 4:
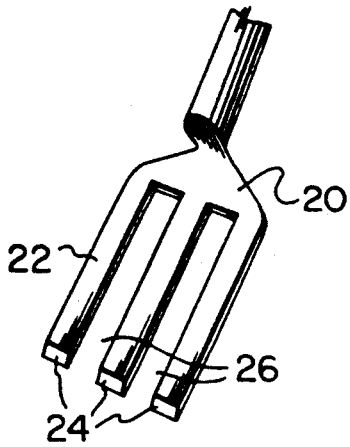
FIG. 4 is an enlarged partial view of the end portion of tine of the tool according to the present invention, illustrating its bevelled end.

At the lower end of lower section 8 is provided a flat blade 20 for slipping beneath shingles to lift and roll them. Blade 20 includes a plurality of longitudinally extending, parallel tines 22 having squared ends 24 which are slightly bevelled downwardly, from their upper surfaces towards the ends to provide a wedge shape at their ends to assist in slipping the blade beneath shingles (FIG. 4).

Fairly large spaces 26 are provided between tines 22 to facilitate the passage of the tines around nails holding existing shingles on roofs, to position the blade 22 for easy lifting and rolling of the shingles. In other words, this spacing of tines 22 allows tool 2 to bracket nails and give full purchase on the underside of the shingle when upper section 6 is forced downwardly towards the roof surface. The normal throw required for lifting and rolling ordinary roofing shingles is one inch to six inches.

To facilitate the lifting and rolling operation, a curved arch member 30 is secured to the rear of lower portion 8 as illustrated, this member extending over most of the length of lower member 8. Member 30 allows prompt contact at the leverage point, during lifting of shingles, while the relatively long upper member 6 of handle 14 promotes ease of work. The tines 22 and rolling fulcrum contact point provided by arc 30 are, as can be seen in FIG. 2, almost in line. As well, the upper part 32 of arch member 30 is generally in line with the longitudinal axis of upper member 6.

A conventional handle grip 34 is preferably provided at the upper end of upper section 6, as illustrated, again to facilitate use of the tool.

It will be understood that, during operation, blade 22 is slipped beneath a nailed shingle on a roof, with tines 22 bracketing the nail. Downward movement of handle grip 34 and the upper end of upper section 6, with arc member 30 resting on the roof behind the shingle removes the shingle and its nails in one motion, speeding the process and, through use of leverage principles and proper adjustment of the angle of upper section 6 with lower section 8, easing the physical strain on a worker using the tool.

Thus it is apparent that there has been provided in accordance with the invention that fully satisfies the objects, aims and advantages set forth above. While the invention has been described in conjunction with a specific embodiment/specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A tool for lifting and rolling for removal of ordinary roofing shingles which have been nailed on roofs, the tool comprising:

(a) an articulated handle having elongated upper and lower sections joined at an intermediate pivot, the lower section angled forwardly, out of alignment with respect to the upper section, the pivot permitting relative pivotal movement of the lower section with respect to the upper section to vary the angle it makes therewith;

(b) means to secure the lower section at an angle within a range of angles with respect to the upper section and maintains that lower section at that angle during operation of the device; and (c) a flat blade secured to the free end of the lower section for slipping beneath shingles, for lifting and rolling thereof, the blade comprising a plurality of spaced tines extending in a direction parallel to the longitudinal axis of the lower section.

2. A tool according to claim 1 wherein the tines have squared ends.

3. A tool according to claim 2 wherein the blade has three tines.

4. A tool according to claim 2 wherein the squared ends of the tines are bevelled from their upper surfaces downwardly to their ends to provide a wedge shape at their ends.

5. A tool according to claim 1 wherein the lower section is provided with a rearwardly extending curved arch, a portion of the arch to rest on a roof and provide a fulcrum point for lifting shingles with the blade when the upper section is lowered with respect to the roof.

6. A tool according to claim 1 wherein the means to secure the lower section in position comprises a turnbuckle having one end secured to a forward part of the upper section and the other end secured to a forward part of the lower section.

7. A tool according to claim 5 wherein the means to secure the lower section in position comprises a turnbuckle having one end secured to a forward part of the upper section and the other end secured to a forward part of the lower section.

8. A tool according to claim 1 wherein the pivot is positioned at a point approximately two-thirds of the way down the handle.

9. A tool according to claim 5 wherein the pivot is positioned at a point approximately two-thirds of the way down the handle.

10. A tool according to claim 5 wherein the arch extends over most of the length of the lower section, being secured to the lower section near its upper and lower ends, the arch joining the upper end in general alignment with the upper section.

11. A tool according to claim 1 wherein a handle grip is secured to the top of the upper section.

12. A tool according to claim 10 wherein the arc is formed and positioned so as to provide alignment of the tines and fulcrum contact point provided on the arch.

* * * * *